US005291155A

United States Patent [19]

Waterman et al.

[11] Patent Number: 5,291,155

[45] Date of Patent: Mar. 1, 1994

[54] MICROWAVE BUFFER

[75] Inventors: Timothy G. Waterman, Eldersburg; Patrick J. Knowles, Laurel, both of Md.

[73] Assignee: Westinghouse Electric Corp., Pittsburgh, Pa.

[21] Appl. No.: 925,829

[22] Filed: Aug. 7, 1992

[51] Int. Cl.[5] ..... H01P 5/12

[52] U.S. Cl. ..... 333/1; 333/128; 333/238

[58] Field of Search ..... 333/1, 125, 127, 128, 333/136, 137, 238

[56] References Cited

U.S. PATENT DOCUMENTS

| | | | |
|---|---|---|---|
| 3,516,024 | 6/1970 | Lange | 333/116 |
| 3,843,941 | 10/1974 | Hudspeth et al. | 333/125 |
| 4,792,770 | 12/1988 | Parekh et al. | 333/137 X |
| 4,947,143 | 8/1990 | Abouzahra et al. | 333/125 |

FOREIGN PATENT DOCUMENTS

| | | | |
|---|---|---|---|
| 44102 | 2/1989 | Japan | 333/128 |

*Primary Examiner*—Paul Gensler

*Attorney, Agent, or Firm*—D. Schron

[57] ABSTRACT

A microwave buffer for use between transmitter modules and an impedance combiner. The buffer is comprised of a plurality of input segments, a plurality of output segments and an elongated transmission segment connecting the input segments to the output segments. The geometry of the buffer along with bridges located proximate to the transmitter modules eliminate the destructive effects of reflected waves set up by an unbalanced impedance combiner when one of the transmission modules becomes inoperative. The hourglass shape of the buffer causes the phases of the signals from each transmission module to be equal from any transmission port to any output. The bridges force the sum of the mutual couplings to be low in amplitude on any transmission module.

5 Claims, 2 Drawing Sheets

MICROWAVE BUFFER

BACKGROUND OF THE INVENTION

1. Field of the Invention

This invention relates generally to the field of microwave transmission and more particularly to a microwave buffer for placement between transmitter modules and an impedance combiner for protecting the remaining circuitry from the destructive effects of a reflected signal caused by a disconnected port.

2. Description of the Prior Art

The solid state transmission of microwave signals is known that utilizes transmitter modules. The power from each transmitter module is combined to form a single, more powerful signal which is transmitted through the antenna. Generally, this is done by running the signals from the transmitter modules through an impedance combiner. When all of the transmitter modules are operating and are connected to a matched load, there are essentially no reflected waves. However, when the voltage from the modules looks into a variable load or a short circuit, the reflected voltage at certain phase angles can add up unevenly and detrimentally to very high voltages if one of the transmitter modules is disconnected. Standing waves develop when the system is unmatched. The standing waves can direct toward any module. If that occurs, the circuitry of that module could be severely damaged. When transmitting signals, it is ideal to transmit in one mode, namely, the in-phase mode. However, when the impedance combiner is larger than a half wavelength and driven unequally more than one mode will be created. Thus, waves are allowed to bounce around inside the system in a resonant fashion known as ringing. When a transmitter module is disconnected, mutual coupling imbalances add together vectorally to produce a standing wave of amplitude and phase error. These waves would then launch themselves back into the feed system (because the undriven port is not loaded) and towards the output port causing the output to oscillate with frequency.

Thus, in microwave transmission systems that utilize combiners of modular transmitters, a means is needed for preventing damage to the circuitry of remaining modules when one is no longer inputting power. This means should also tend to keep the output as in-phase and as low loss as possible, accounting only for the loss of the module disconnected.

SUMMARY OF THE INVENTION

We provide a microwave buffer for use between transmitter modules and an impedance combiner. The buffer is comprised of a plurality of input segments, a plurality of output segments and an elongated transmission segment connecting the input segments to the output segments. The geometry of the buffer along with bridges located proximate to the transmitter modules eliminate the destructive effects of reflected waves set up by an unbalanced impedance combiner when one of the transmission modules becomes inoperative. The hourglass shape of the buffer causes the phases of the signals from each transmission module to be equal from any transmission port to any output. The bridges force the sum of the mutual couplings to be low in amplitude on any transmission module.

DESCRIPTION OF THE PREFERRED EMBODIMENTS

The present microwave buffer is employed in a microwave transmission system having a series of input ports of corresponding transmitter modules, and a series of output ports leading to an impedance combiner. The present buffer has a series of input segments for connection to the input ports. Additionally, the buffer has a series of output segments for connection to the output ports. A transmission segment then connects the input segments to the output segments.

Figure 1:
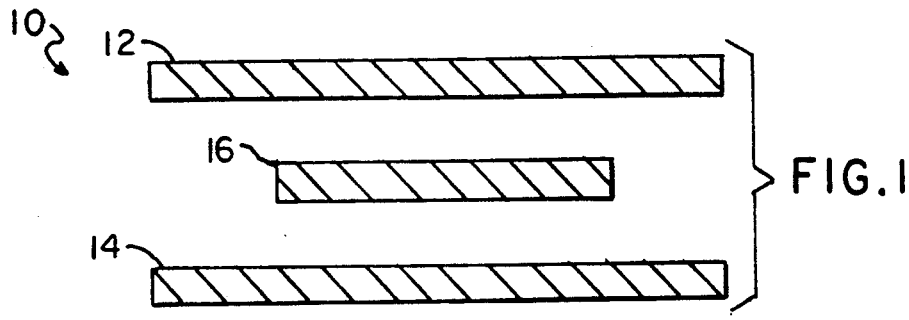
FIG. 1 is a front view in cross-section of the present buffer.

Referring to FIG. 1, a preferred embodiment employing strip line for the transmission of electromagnetic waves is shown which acts as a buffer. The buffer 10 consists of an upper conductor plate 12 that is parallel to and spaced at some distance to a lower conductor plate 14. A center conductor 16 is disposed between and is parallel to the upper conductor plate 12 and the lower conductor plate 14.

Figure 2:
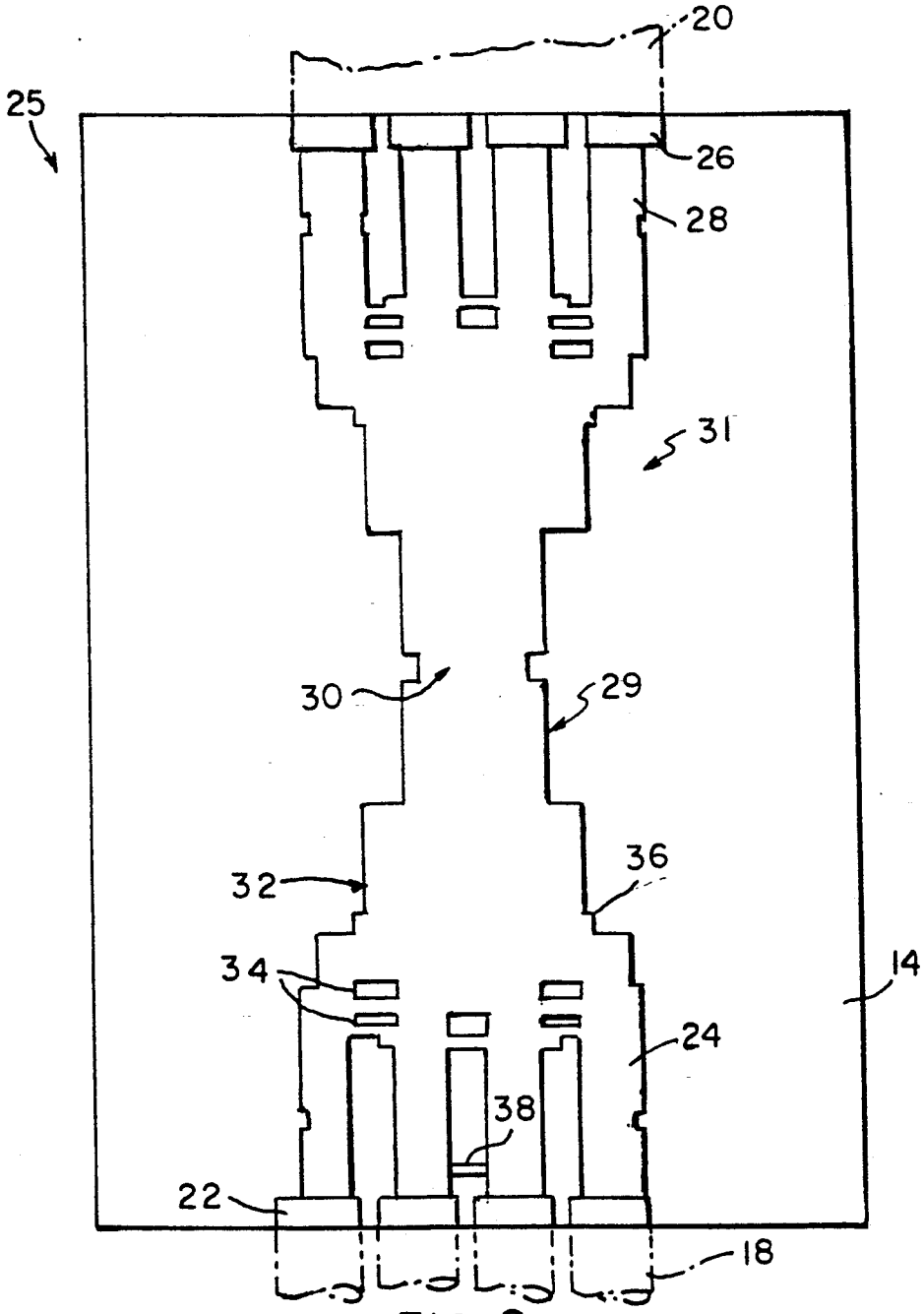
FIG. 2 is a top plan view of the center conductor and lower conductor plate of a first preferred embodiment of the present buffer.

Referring to FIG. 2, a first preferred embodiment is shown of a strip line buffer for use in a microwave transmission system having eight transmitter modules 18 (four of which are shown) and eight output ports 26 (four of which are shown) feeding the impedance combiner 20. In this system, it is preferred that two buffers 25 be used, each having a center conductor 31 that has four input segments 24 and four output segments 28 (this embodiment will be hereinafter referred to as the 4×4 buffer). Buffer 25 is used to connect the inputs from a series of transmitter modules 18 to an impedance combiner 20. The signals from each transmitter module 18 enter the buffer 25 through a corresponding input port 22. The signals are transferred from each input port 22 and travel along a respective input segment 24 of center conductor 31 within buffer 25. The signals travel through buffer 25 along each input segment 24. The signals are then directed along output segments 28 of center conductor 31 of buffer 25. The signals leave the output segments 28 of center conductor 31 of buffer 25 and enter the impedance combiner 20 through output ports 26.

The center conductor 31 of buffer 25 is preferably designed so that the transmission segment 29 has a generally hourglass configuration. That is, the width of the center conductor 31 at the convergence area 30 is less than the width of the center conductor 31 at the input ports 22. And the transmission segment 29 narrows at the convergence area. Similarly, this narrowing of the center conductor 31 also occurs from the output ports 26 to the convergence area 30. Thus, the center conductor 31 of a preferred buffer 25 has a generally hourglass-shaped configuration. As signals travel through each input segment 24, the signals converge at the convergence area 30. The signals then travel along output segments 28 and exit through the output ports 26. The hourglass configuration of center conductor 31 has the effect of forcing the line length from any one input port 22 to any one output port 26 to be within plus or minus ten degrees. The result of the similar path lengths is that a single radiation area is detected from either the input side or the output side of the buffer 25. This single radiation area occurs at the convergence area 30. The single radiation area has the effect of outputting equal voltages to each of the impedance combiner ports 26. The power that is outputted to any impedance combiner port 26 is equal to the sum of the powers from the operating transmitter module 18 divided by the number of output ports. Thus, no matter how many transmitter modules are operational, an equal distribution of powers occurs at the output ports 26 to the impedance combiner 20. For example, with the 4×4 buffer, if a uniform power of Pi is transmitted into each input port 22, then the power Po at each output port 26 would be 4Pi/4 which equals Pi, thus with all modules operational, Pi=Po. However, if one of the transmitter modules 18 is not operational so that only three of the four transmitters are operating, the power Po at each output port 26 would be 3Pi/4. And since the combiner 20 is being provided a uniform power, no reflections occur.

Preferably, the reductions in width of the center conductor 31 from the input ports 22 to the convergence area 30 and from the output ports 26 to the convergence area 30 occur in steps 32. To keep the buffer 25 matched with the load of the impedance combiner 20, several transformations are necessary along the buffer 25. These are accomplished at steps 32 which we designed to be quarter-wavelength long for each step 32. Thus, the buffer 25 also acts as several quarter-wavelength transformers.

Several other features in the geometry of the center conductor 31 contribute to the reduced ringing effect. These features include spaces 34 and protrusions 36. These spaces 34 and protrusions 36 are ways in which the line length between any two input ports 22 can be altered so that the sum of the signals at any one input port 22 would be close to zero. This summing occurs because the interference among signals occupying the same area results in a signal that is the net sum of the superpositioned signals. Thus, by adjusting the length of travel of each signal the signals can be caused to combine so that the net signal is very nearly zero.

Another device that allows the lengths between input ports 22 to be modified is the use of bridges 38. The bridges 38, which are conductive, allow paths of travel for the signals between the input segments 24. These paths of travel can be adjusted by the selective size and placement of the bridges 38. Furthermore, the paths of travel can be adjusted so that the signals that combine at any input segment 24 proximate to an input port 22 can be combined in a selected manner. Thus, when any one input port 22 fails to deliver a signal for any reason, the geometry of the center conductor 31 at the input segments 24 is such that the phases and amplitudes of the contributing signals from the remaining input ports 22 have a vector sum that is as low as possible at the inoperative port.

Figure 3:
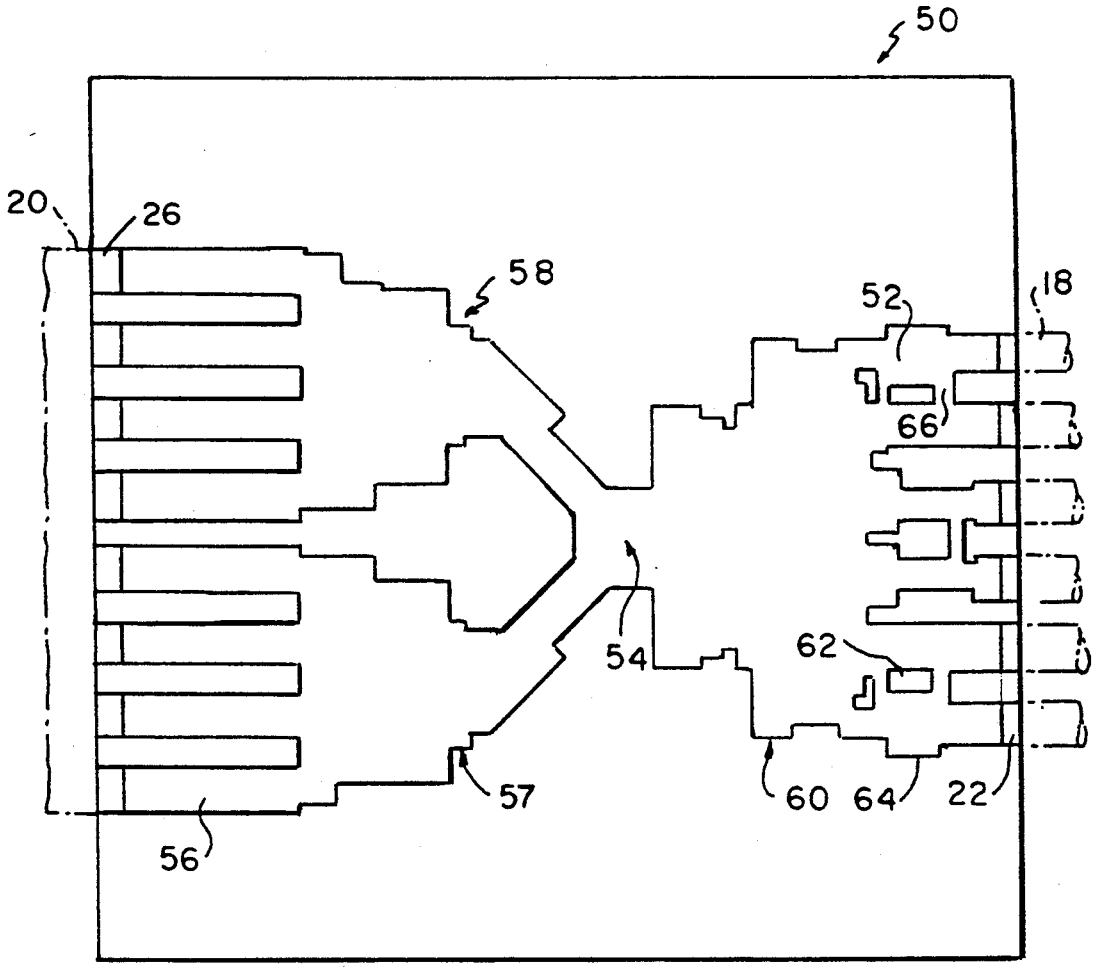
FIG. 3 is a top plan view of the center conductor and lower conductor plate of a second preferred embodiment of the present buffer.

Referring next to FIG. 3, a second preferred embodiment is shown for use in a microwave transmission system having six transmitter modules 18 and eight output ports 26, feeding the impedance combiner 20. For this system, it is preferred that one buffer 50 be used having a center conductor 58 that has six input segments 52 and eight output segments 56 (this embodiment will be hereinafter referred to as the 6×8 buffer). A transmission segment 57 then connects the input segments 52 to the output segments 56. The function of the 6×8 buffer 50 is similar to that of the 4×4 buffer 25 in that the buffer 50 connects the inputs from a series of transmitter modules 18 to an impedance combiner 20. Signals are transferred from the transmitter modules through input ports 22 to a respective input segment 52 of center conductor 58 of buffer 50. The signals travel through buffer 50 along each input segment 52 and converge at a convergence area 54. The signals are then directed through buffer 50 along output segments 56 of center conductor 58. The signals then enter the impedance combiner 20 through output ports 26.

The center conductor 58 of buffer 50 is also designed so that the transmission segment 57 has a generally hourglass configuration. The width of the center conductor 58 at the convergence area 54 is less than the width of the center conductor 58 at either the input ports or the output ports. And the width of the transmission segment narrows at the convergence area. This hourglass configuration forces the line length from any one input port 22 to any one output port 26 to be within plus or minus ten degrees. The similar path lengths result in a single radiation area occurring at the convergence area 54.

The reductions in width of the center conductor 58 from the input ports 22 to the convergence area 54 and from the output ports 26 to the convergence area 54 preferably occur in steps 60. The steps 60 are preferably designed to be a quarter wavelength each so as to act as several quarter wavelength transformers. Spaces 62 and protrusions 64 are provided to favorably alter the line length between any two input ports 22 so that the sum of the signals at any one input port 22 is close to zero. Bridges 66 are also provided as adjustments to the line length of the paths of travel for the signals so that the combined signals from adjacent input ports 22 have a low vector sum.

Variations of the present invention could be made. For example, although the preferred embodiments of the buffer show a 4×4 buffer and a 6×8 buffer, it is understood that a buffer could be designed that would reduce feedback damage for any number of input ports 22 and output ports 26. This is done by simply designing more or less input segments and output segments. Thus, the present invention could be modified for use with a system using any number of transmitter modules.

In an alternative embodiment, the input segments 24, output segments 28 and transmission segment 29 of the buffer are fabricated from microstrip circuitry. The microstrip circuitry is hourglass-shaped to create a convergence area which provides equal power distribution to the output ports 26 while protecting the module circuitry from destructive reflections.

In yet another alternative embodiment, the input segments 24, output segments 28 and transmission segment 29 of the buffer are waveguides. In this embodiment, the hourglass shape of the buffer also causes a convergence area to form, allowing an equal distribution of powers to the output ports 26 while protecting the module circuitry from destructive reflections.

While certain present preferred embodiments have been shown and described, it is to be distinctly understood that the invention is not limited thereto but may be otherwise embodied within the scope of the following claims.

What is claimed is:

1. A microwave buffer for transferring electromagnetic signals from a series of input ports connected to a corresponding number of transmitter modules to a series of output ports of an impedance combiner, said buffer comprising:

a flat lower conductor plate;

a flat upper conductor plate, said upper conductor plate being parallel and spaced at some distance from said lower conductor plate; and a center conductor plate being disposed between and being parallel to said upper conductor plate and said lower conductor plate, said center conductor plate having a plurality of input segments connected to said input ports, and a plurality of output segments connected to said output ports, in which at least one conductive bridge connects pairs of adjacent input segments.

2. The microwave buffer of claim 1 wherein each said input segment of said buffer has only one conductive bridge.

3. The microwave buffer of claim 1 wherein said center conductor has an hourglass configuration.

4. The microwave buffer of claim 3 wherein said hourglass configuration is stepped.

5. The microwave buffer of claim 4 wherein said stepped hourglass configuration of said center conductor has one-quarter wavelength steps.

* * * * *